US007175339B2

(12) United States Patent
Bisig

(10) Patent No.: US 7,175,339 B2
(45) Date of Patent: Feb. 13, 2007

(54) ELECTRONIC OBJECT OF SMALL DIMENSIONS CAPABLE OF BEING WORN ON THE WRIST

(75) Inventor: Martin Bisig, Zuchwil (CH)

(73) Assignee: Eta SA Fabriques d'Ebauches, Grenchen (CH)

( * ) Notice: Subject to any disclaimer, the term of this patent is extended or adjusted under 35 U.S.C. 154(b) by 435 days.

(21) Appl. No.: 10/300,875

(22) Filed: Nov. 21, 2002

(65) Prior Publication Data

US 2003/0099161 A1 May 29, 2003

(30) Foreign Application Priority Data

Nov. 26, 2001 (CH) ..... 2172/01

(51) Int. Cl.
*G04B 37/00* (2006.01)
*G04C 10/00* (2006.01)

(52) U.S. Cl. ..... 368/282; 368/204

(58) Field of Classification Search ..... 368/203–205, 368/282, 281, 64; 320/108, 114; 439/37; 343/718; 455/575.6; 63/21
See application file for complete search history.

(56) References Cited

U.S. PATENT DOCUMENTS 3,675,108 A * 7/1972 Nicholl ..... 320/108
4,873,677 A * 10/1989 Sakamoto et al. ..... 368/204
5,303,305 A * 4/1994 Raimo et al. ..... 381/323
5,550,452 A * 8/1996 Shirai et al. ..... 320/108
5,564,082 A * 10/1996 Blonder et al. ..... 455/575.6
5,686,882 A * 11/1997 Giani ..... 340/407.1
5,929,598 A * 7/1999 Nakama et al. ..... 320/108
6,158,884 A * 12/2000 Lebby et al. ..... 368/282
6,224,254 B1 * 5/2001 Hayek et al. ..... 368/281
6,316,909 B1 * 11/2001 Honda et al. ..... 320/108
6,350,055 B1 * 2/2002 Barras ..... 368/281
6,396,771 B2 * 5/2002 Paratte ..... 368/203
6,528,203 B1 * 3/2003 Mitamura ..... 429/98
6,535,376 B2 * 3/2003 Fujita et al. ..... 361/625
6,590,835 B2 * 7/2003 Farine et al. ..... 368/10
6,619,835 B2 * 9/2003 Kita ..... 368/281
6,788,621 B2 * 9/2004 Meylan et al. ..... 368/10
6,816,440 B2 * 11/2004 Born et al. ..... 368/69
6,854,978 B2 * 2/2005 Noirjean ..... 439/37
2001/0043515 A1 11/2001 Yasuhiro
2002/0141289 A1 * 10/2002 Hayek et al. ..... 368/47
2003/0099164 A1 * 5/2003 Noirjean et al. ..... 368/282

FOREIGN PATENT DOCUMENTS

DE 29815621 U1 * 1/2000
EP 298 707 A2 1/1989
GB 2 201 266 8/1988
GB 2 314 470 12/1997

* cited by examiner

*Primary Examiner*—Vit Miska
*Assistant Examiner*—Jeanne-Marguerite Goodwin
(74) *Attorney, Agent, or Firm*—Sughrue Mion, PLLC

(57) ABSTRACT

The present invention concerns a portable object such as a timepiece (18) capable of being worn on a user's wrist by means of a wristband, this portable object being supplied with electric power by at least one rechargeable accumulator able to be recharged by induction charging means, these inductive charging means including a primary winding (56) and a secondary winding (2), said portable object being characterised in that the secondary winding (2) is housed in a strand (16, 26) of the wristband.

11 Claims, 3 Drawing Sheets

ELECTRONIC OBJECT OF SMALL DIMENSIONS CAPABLE OF BEING WORN ON THE WRIST

The present invention concerns an electronic object such as a timepiece, capable of being worn on a user's wrist.

There are currently on the market multifunction timepieces that allow the persons wearing them not only to access various time-related information, but also to receive and, if necessary to transmit, for example radiobroadcast information concerning the state of road traffic, market prices or the weather forecast.

In addition to the large number of functions that they are capable of fulfilling, the watches of the aforementioned type have the peculiarity of being, in most cases, very high power consumers. This is why they are usually powered, not by disposable batteries whose energy storage capacity is limited, but by accumulators that can be periodically recharged by means of electric chargers provided for this purpose.

The accumulators can be charged via ohmic contacts provided on the watchcase and by means of which said multifunction watch is connected to its charger. The drawbacks of such ohmic contacts are, however, well known. They are seriously detrimental, in particular, to the sealing of the watch to which they are fitted, offering an easy access passage to water, dust and moisture.

In order to overcome these drawbacks, techniques for charging accumulators via induction have been used. In this case, the charger includes a winding which constitutes the primary of a charge transformer, while the secondary winding of the transformer is placed in the charge circuit or the rechargeable accumulator(s), inside the watch.

The induction charging technique advantageously allows the watch accumulators to be charged without any contacts and without any lead wires. It thus allows ohmic contacts, which are usually provided to connect said accumulators to an external charger, to be omitted. This technique however requires the watchcase to be preferably made of a plastic material. Indeed, a watchcase made of a metal material would reduce the efficiency of the electromagnetic coupling between the primary and secondary windings of the charge transformer. In order to keep the same charge efficiency as that observed with a case made of plastic material, the charge current frequency would thus have to be increased, in the case of a metal case, running the risk of breaching the standards regulating the exposure of the population to electromagnetic fields. The choice of materials that can be used to make watches intended to be recharged by induction is thus limited, which constitutes a serious handicap for watch manufacturers who experience difficulties in order to be able to adapt to changes in fashion and the demands of clients.

The object of the present invention is to overcome the aforementioned drawbacks, in addition to others, by proposing an electronic object such as a wristwatch whose accumulators can be recharged via induction in a simple manner while guaranteeing an optimum charge of such accumulators.

The present invention therefore concerns a portable object such as a wristwatch capable of being worn on a user's wrist by means of a wristband, this portable object being supplied with electric power by at least one rechargeable accumulator able to be recharged by induction charging means, these induction charging means including a primary winding and a secondary winding, said portable object being characterised in that the secondary winding is housed in the wristband.

Owing to these features, the present invention provides a portable object, in particular a wristwatch, whose case can be made of any type of material, which leaves watch manufacturers complete freedom to adapt to changes in fashion or to answer specific requirements emanating from the clientele. Moreover, although the watch can be made, in particular, of metallic materials, the present invention retains all the advantages linked to charging accumulators via induction, namely the absence of any contact and lead wires, which enables a case free of connectors to be provided, whose sealing is thus easier to guarantee.

According to a complementary feature of the invention, the conductive paths forming the secondary winding are arranged on at least one of the faces, and preferably on both faces, of an insulating substrate.

Indeed, the fact of being able to have a significant number of conductive paths to form the secondary winding advantageously allows the accumulator charge current frequency to be reduced, which prevents any risk of breaching the limit values in terms of exposing the population to the electromagnetic radiation decreed by the standards currently in force.

According to a first embodiment of the invention, the insulating substrate on which the secondary winding is deposited, is embedded by moulding in the thickness of a wristband made of a flexible material such as plastic or an elastomer.

According to a second embodiment, the insulating substrate on which the secondary winding is deposited is introduced into a sheath-shaped wristband.

As already mentioned in the preamble of the present Patent Application, the portable object according to the invention is particularly intended for picking up radiobroadcast type information. Therefore, it has to be fitted with a receiving antenna. Both the secondary winding and the antenna can advantageously be deposited on the same insulating substrate, which simplifies the manufacturing method and thus makes significant savings in terms of time and money.

Other features and advantages of the present invention will appear more clearly from the following detailed description of an embodiment of the portable object according to the invention, this example being given purely by way of non-limiting illustration, with reference to the annexed drawings, in which.

The present invention proceeds from the general inventive idea consisting in arranging the secondary winding of an induction charge device in a different location than the case of a portable object powered by accumulators intended to be recharged by means of the charge device. By doing this, full advantage is taken of the advantages linked to induction charging which avoids, in particular, having to use ohmic contacts that are detrimental to the sealing of the case, while avoiding one of the only problems of the inductive charge, namely the limited choice of materials able to be used for manufacturing the case.

The present invention will be described with reference to a timepiece of the wristwatch type. It goes without saying that the invention is not limited to such an embodiment and that it can be applied to any type of electronic object of small dimensions able to be worn by a user on his wrist by means of a wristband.

Figure 1:
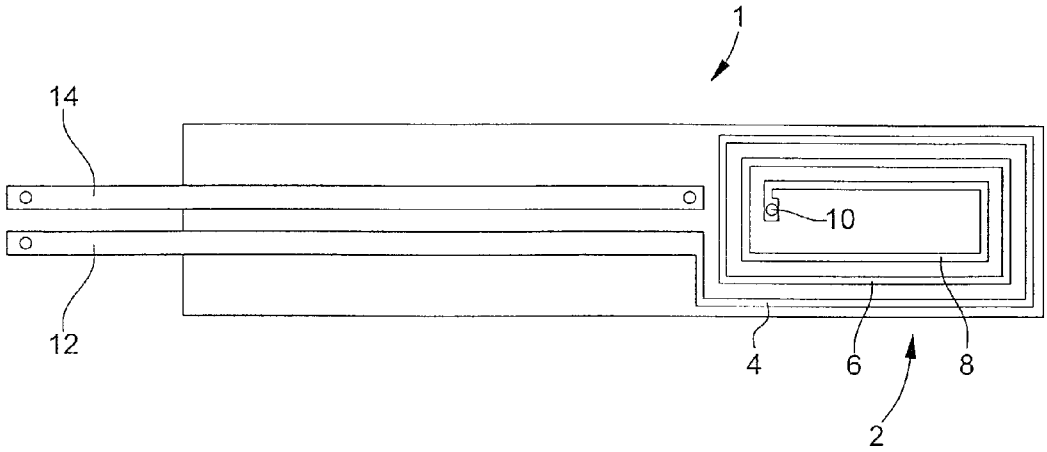
FIG. 1 is a general top view of an insulating substrate on which the secondary winding is arranged.

FIG. 1 is a top view of an insulating substrate on which the secondary winding is deposited. Designated as a whole by the reference numeral 1, this substrate has the form of a flexible band made, for example of Kapton ®, or any other insulating material having the requisite flexibility. Secondary winding 2 is disposed on at least one of the faces, and preferably on both faces of insulating substrate 1. Indeed, the higher the number of turns 4 forming secondary winding 2, the lower the frequency of the inductive charge current, which avoids breaching the current standards relating to the exposure of the public to electromagnetic radiation.

As can be seen in FIG. 1, secondary winding 2 has an external perimeter formed by its external turn 4 of substantially rectangular shape. The other turns 6 and 8 are disposed in a concentric manner with respect to external turn 4. Turns 6 and 8, which are also of rectangular shape, are of gradually decreasing dimensions.

Turns 4 to 8 of secondary winding 2 are deposited on insulating substrate 1 by any appropriate technique such as, for example, photolithography. In such case, a thin film of a conductive material such as copper is first bonded onto the surface of the substrate. This film of conductive material is then coated with a layer of photoresist which will be exposed to a light beam through the apertures of a mask reproducing the desired shape of secondary winding 2. After the photoresist has been developed, the zones of the copper film that are not covered by the resist are then chemically etched. Finally the remaining resist is removed.

Turns 4 to 8 arranged on the top face of insulating substrate 1 and the turns (not shown) arranged on the bottom face of said substrate 1 are conventionally connected to each other by through vias or holes (also not shown) located beneath a contact pad 10 provided at the free end of inner turn 8.

For reasons of convenience, both ends 12 and 14 of secondary winding 2 are arranged on the same top face of insulating substrate 1, the first end 12 being connected to external turn 4 of said secondary winding 2, whereas the second end 14 is connected via a through hole passing through the thickness of said substrate and metallised in order to be able to be conductive to the turns arranged on the bottom face of said substrate 1.

Figure 2:
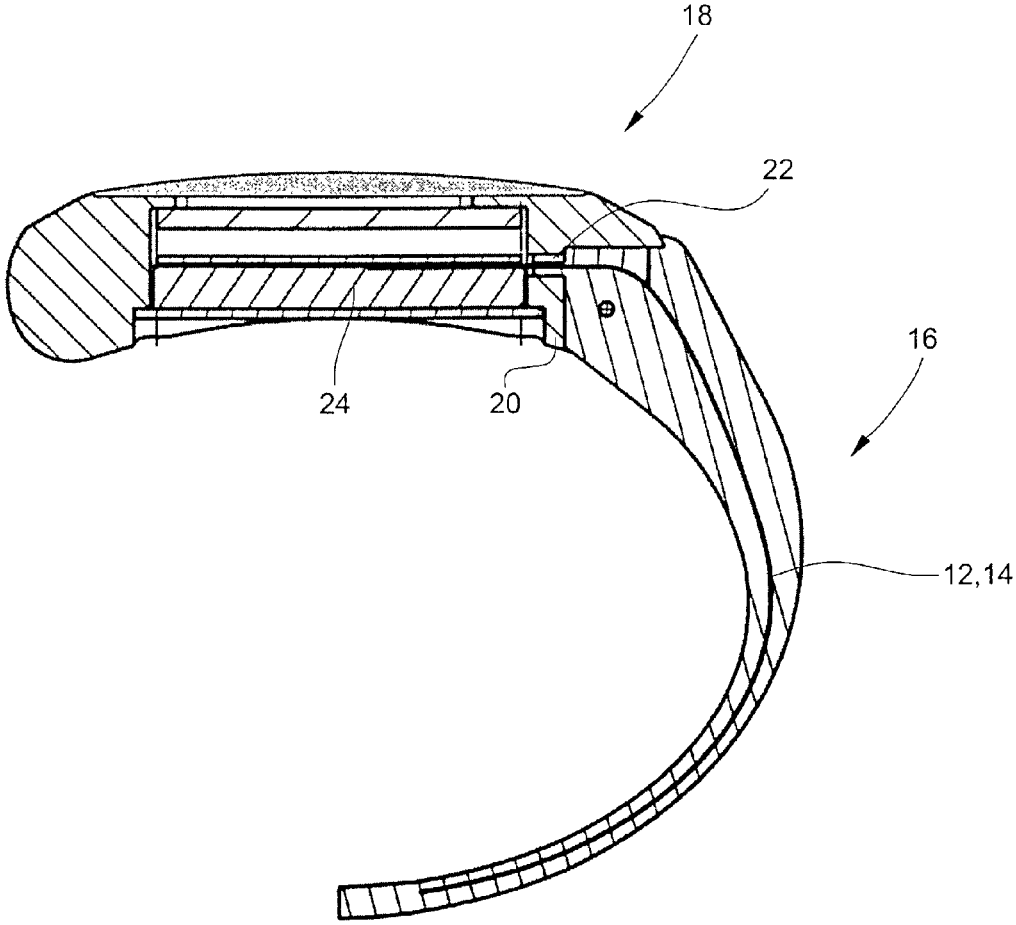
FIG. 2 is a longitudinal cross-section of a wristband strand overmoulded around the insulating substrate carrying the secondary winding.

According to a first embodiment of the invention shown in FIG. 2, substrate 1 and the various turns of secondary winding 2 that are arranged at its surface, are overmoulded using a sufficiently flexible and resistant plastic material or elastomer to be able to form one of the strands 16 of the watch wristband. As can be seen in FIG. 2, both ends 12 and 14 of secondary winding 2 extend over practically the entire length of wristband strand 16 of watch 18 and penetrate case 20 of said watch 18 through a hole 22. Inside case 20 of watch 18, the ends 12 and 14 of secondary winding 2 are fixed onto a printed circuit board 24 preferably via screws. In fact, the case in which the wristband of watch 18 is worn and has to be replaced should be envisaged. In such case, it is easy to replace the worn wristband by a new one insofar as the ends of the secondary winding embedded in the new wristband will only need to be screwed onto the printed circuit board.

Since the impervious passage of the ends of the secondary winding through case 20 of wristwatch 18 does not form the subject of the present Patent Application, it will not be described here. For such questions, reference may advantageously be made to the European Patent Application published under number EP 1 033 636 in the name of the Applicant.

Figure 3:
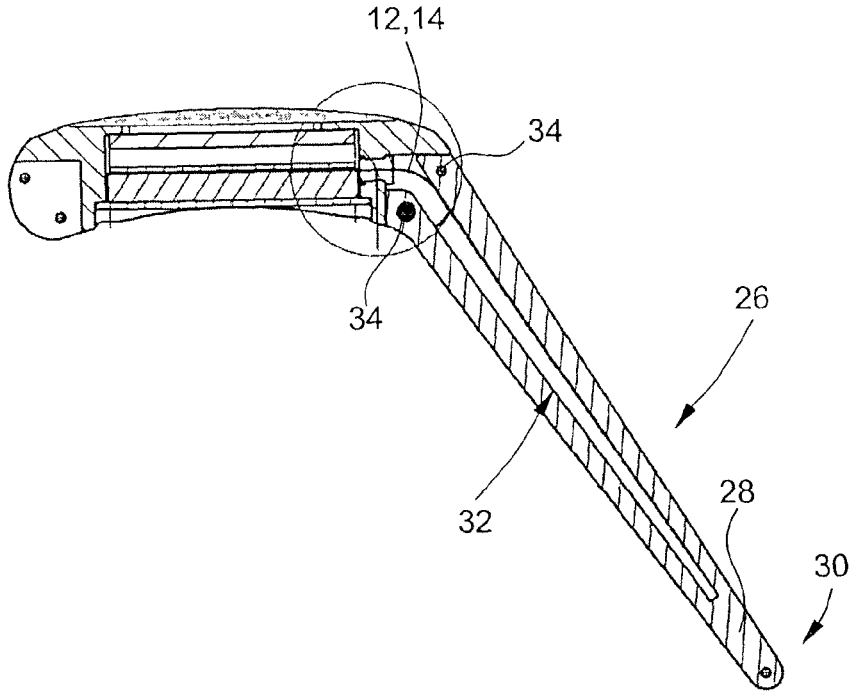
FIG. 3 is a longitudinal cross-section of a strand of a sheath-shaped wristband into the inner cavity of which the secondary winding is inserted.
Figure 4:
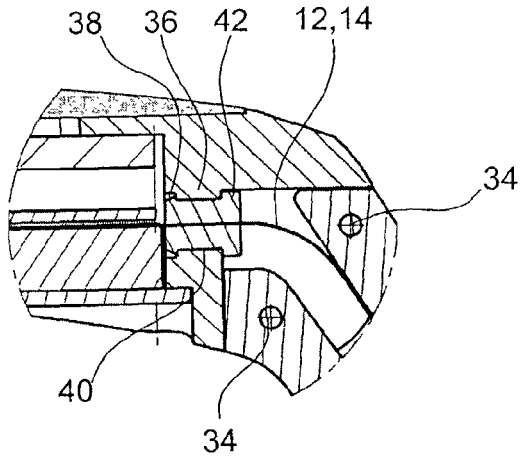
FIG. 4 is a larger scale view of the region surrounded by a circle in FIG. 3.

Another solution that may be envisaged for mounting insulating substrate 1 and conductive structures formed at its surface consists simply in inserting the latter into the cavity of a sheath-shaped wristband. In this case, the ends of the secondary winding can be secured by soldering or bonding onto the printed circuit board contained in the watchcase since, in order to replace a worn wristband, the latter need only be pulled slightly to remove insulating substrate 1. This second solution is shown with reference to FIG. 3 in which it can be seen that wristband strand 26 of watch 18 is formed by a band 28 bent at its end 30 and whose longitudinal edges can be fixed to each other for example by thermowelding or bonding in the case of a plastic wristband, or sewn in the case of a leather wristband. Band 28 thus folded in two delimits a cavity 32 into which the two ends 12 and 14 of secondary winding 2 are inserted. Since it is not necessary, in this case, to open case 20 of watch 18 to disconnect ends 12 and 14 from printed circuit board 24 when one wishes to change the wristband, said ends 12 and 14 of the secondary winding can be permanently secured to said printed circuit board 24, particularly by soldering. The two portions of band 28 bent to form strand 26 bare fixed to case 20 of watch 18 by means of bars 34. A sealing gasket 36 is moulded onto ends 12 and 14 of secondary winding 2. This gasket has a head 38 the diameter of which is slightly greater than that of hole 40 arranged in case 20 in which said gasket 36 is engaged. Passing through hole 40, head 38 of gasket 36, made of an elastomeric material, is compressed and returns to its initial shape once it leaves said hole 40, thus immobilising gasket 36 owing to a flange 42 that this gasket 36 has at its other end, at a distance from head 38 equal to the length of hole 40 (see FIG. 4).

Figure 5:
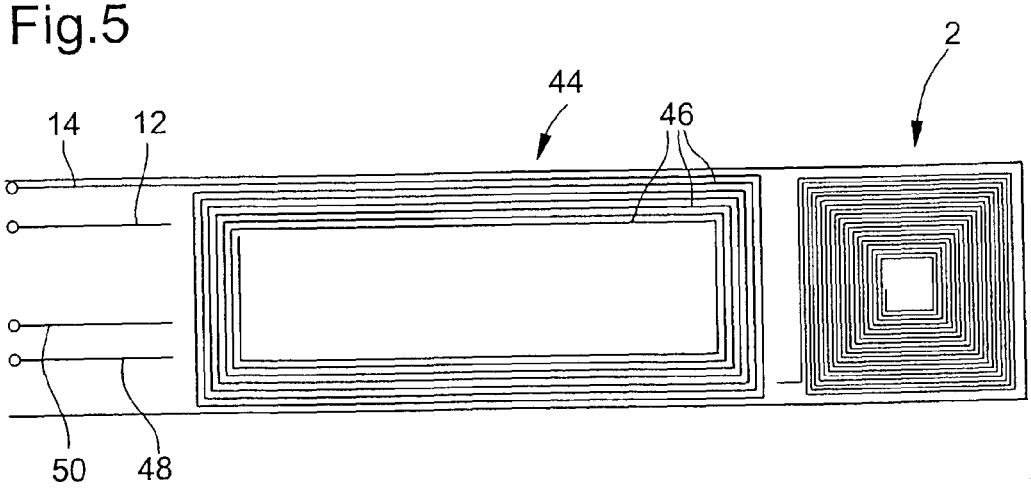
FIG. 5 is a top view of an insulating substrate on which a secondary winding and an antenna for picking up radiobroadcast information are deposited.

Wristwatch 18 according to the invention is intended, in particular, for picking up information broadcast by radio waves. Thus, it has to include an antenna which, as can be seen in FIG. 5, can advantageously be arranged on the same insulating substrate 1 as secondary winding 2. Designated by the reference numeral 44, this antenna is formed of several concentric turns 46, for example of rectangular shape, and includes two ends 48 and 50. These ends 48 and 50 of antenna 44 can be independent of ends 12 and 14 of the secondary winding, or be coupled thereto. In the latter case, the electric signals routed by the antenna and by the secondary winding are uncoupled in case 20 of watch 18 using capacitive decoupling means.

Figure 6:
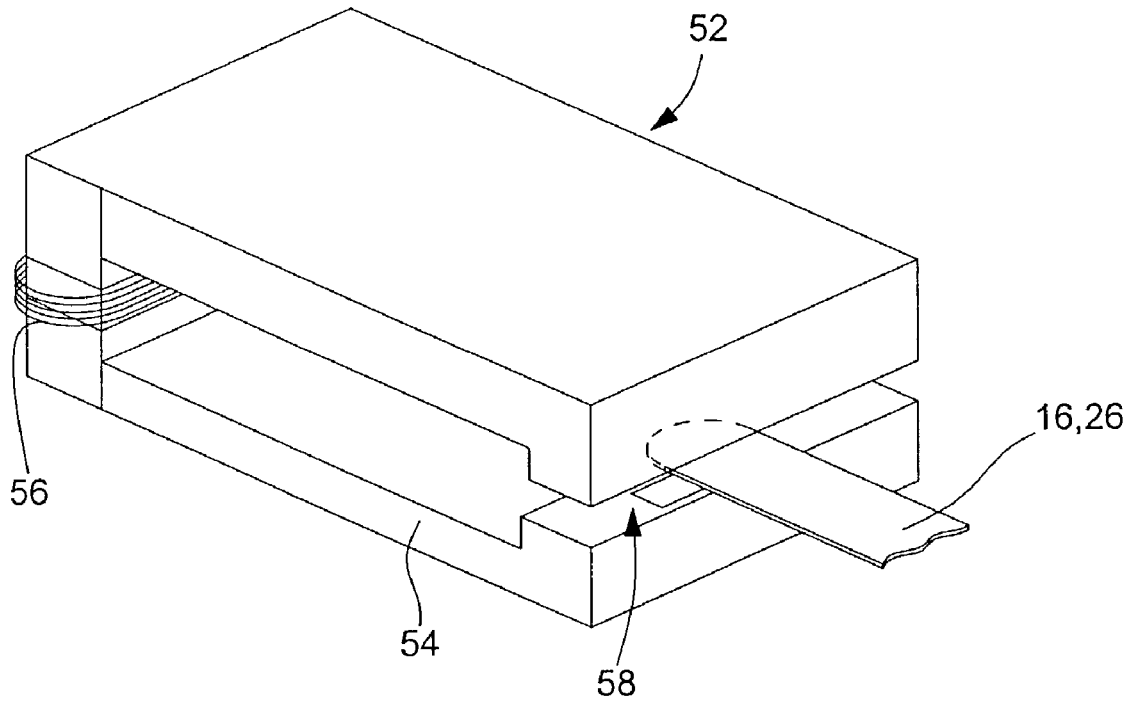
FIG. 6 is a schematic perspective view of an electric charger.

FIG. 6 is a schematic diagram of the electric charger intended to recharge the accumulators of watch 18. Designated as a whole by the reference numeral 52, this charger is mainly formed of a ferrite core 54 around which primary winding 56 is wound. In order to recharge the accumulators of watch 18, strand 16 or 26 enclosing secondary winding 2 in its thickness need only be arranged in air gap 58 formed by core 54.

It goes without saying that the invention is not limited to the embodiments which have just been described, and that various simple modifications and variants can be envisaged without departing from the scope of the present invention.

What is claimed is:

1. A portable object capable of being worn on a user's wrist by means of a wristband, this portable object being supplied with electric power by at least one rechargeable accumulator able to be recharged by induction charging means, these inductive charging means including a primary winding and a secondary winding, wherein the secondary winding is housed in a strand of the wristband, wherein the conductive turns forming the secondary winding are arranged on at least one of the faces of an insulating substrate, and wherein the secondary winding is formed by its external turn of rectangular shape, the other turns being concentrically arranged with respect to the external turn, their dimensions gradually decreasing.

2. The portable object according to claim 1, wherein the insulating substrate on which the secondary winding is arranged is inserted into a strand of a sheath-shaped wristband.

3. A portable object capable of being worn on a user's wrist by means of a wristband, this portable object being supplied with electric power by at least one rechargeable accumulator able to be recharged by induction charging means, these inductive charging means including a primary winding and a secondary winding, wherein the secondary winding is housed in a strand of the wristband, wherein the conductive turns forming the secondary winding are arranged on at least one of the faces of an insulating substrate, wherein the secondary winding is formed by its external turn of rectangular shape, the other turns being concentrically arranged with respect to the external turn, their dimensions gradually decreasing, and wherein a sealing gasket is moulded onto the two free ends of the secondary winding, this sealing gasket having a head whose diameter is greater than that of a hole arranged in a case of the portable object and a flange which immobilises it axially.

4. The portable object according to claim 3, wherein the secondary winding and the antenna are coupled, capacitive decoupling means being provided in the portable object in order to decouple the electric signals routed by said secondary winding and by said antenna respectively.

5. A portable object capable of being worn on a user's wrist by means of a wristband, this portable object being supplied with electric power by at least one rechargeable accumulator able to be recharged by induction charging means, these inductive charging means including a primary winding and a secondary winding, wherein the secondary winding is housed in a strand of the wristband, wherein the conductive turns forming the secondary winding are arranged on at least one of the faces of an insulating substrate, wherein the secondary winding is formed by its external turn of rectangular shape, the other turns being concentrically arranged with respect to the external turn, their dimensions gradually decreasing, wherein the insulating substrate, on which the secondary winding is arranged, is embedded in the thickness of a strand of the wristband made of a flexible material, and wherein the secondary winding includes two free ends that are screwed, bonded or soldered onto a printed circuit board enclosed in the case of a portable object.

6. A portable object capable of being worn on a user's wrist by means of a wristband, this portable object being supplied with electric power by at least one rechargeable accumulator able to be recharged by induction charging means, these inductive charging means including a primary winding and a secondary winding, wherein the secondary winding is housed in a strand of the wristband, the conductive turns forming the secondary winding being arranged on at least one of the faces on an insulating substrate, the secondary winding being formed by its external turn of rectangular shape, the other turns being concentrically arranged with respect to the external turn, their dimensions gradually decreasing, a sealing gasket being moulded onto the two free ends of the secondary winding, this sealing gasket having a head whose diameter is greater than that of a hole arranged in a case of the portable object and a flange which immobilises it axially.

7. The portable object according to claim 6, wherein an antenna is arranged on the same insulating substrate as the secondary winding.

8. The portable object according to claim 7, wherein the secondary winding and the antenna are coupled, capacitive decoupling means being provided in the portable object in order to decouple the electric signals routed by said secondary winding and by said antenna respectively.

9. The portable object according to claim 6, wherein the secondary winding is structured by photolithography on the surface of the insulating substrate.

10. The portable object according to claim 6, wherein the insulating substrate on which the secondary winding is arranged is inserted into a strand of a sheath-shaped wristband.

11. The portable object according to claim 6, wherein the secondary winding includes two free ends that are screwed, bonded or soldered onto a printed circuit board enclosed in the case of the portable object.

* * * * *